United States Patent [19]

Whalen

[11] 3,942,585

[45] Mar. 9, 1976

[54] FOUR RISER HEATING AND COOLING SYSTEM

[76] Inventor: James J. Whalen, Clarkson Drive, Fulton, Md. 20759

[22] Filed: June 7, 1974

[21] Appl. No.: 477,342

[52] U.S. Cl. ..... 165/50; 165/48; 165/125

[51] Int. Cl.[2] ..... F24F 3/00

[58] Field of Search ..... 165/50, 48, 125

[56] References Cited

UNITED STATES PATENTS

| | | | |
|---|---|---|---|
| 3,074,477 | 1/1963 | Whalen | 165/50 |
| 3,648,766 | 3/1972 | Whalen | 165/48 |
| 3,685,575 | 8/1972 | Henriot | 165/50 |
| 3,722,580 | 3/1973 | Braver | 165/50 |
| 3,765,478 | 10/1973 | Whalen | 165/50 |

FOREIGN PATENTS OR APPLICATIONS

| | | | |
|---|---|---|---|
| 161,658 | 5/1933 | Switzerland | 165/125 |

*Primary Examiner*—Charles J. Myhre
*Assistant Examiner*—Daniel J. O'Connor
*Attorney, Agent, or Firm*—Browdy and Neimark

[57] ABSTRACT

A heating and cooling unit for a multistory building comprises a single elongated housing having a pair of riser heat exchangers and a pair of fans therein. One riserheat exchanger and one fan are positioned on one side of the housing, while the other heat exchanger and fan are position on the other side of the housing. An insulated partition separates the one riser and fan from the other riser and fan.

14 Claims, 5 Drawing Figures

FIG. 1
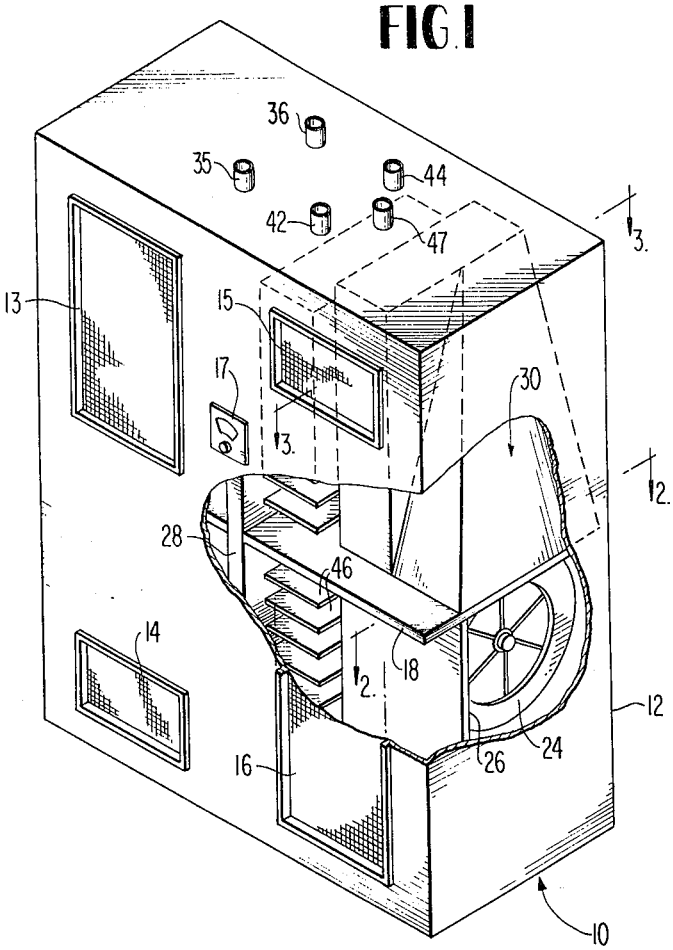
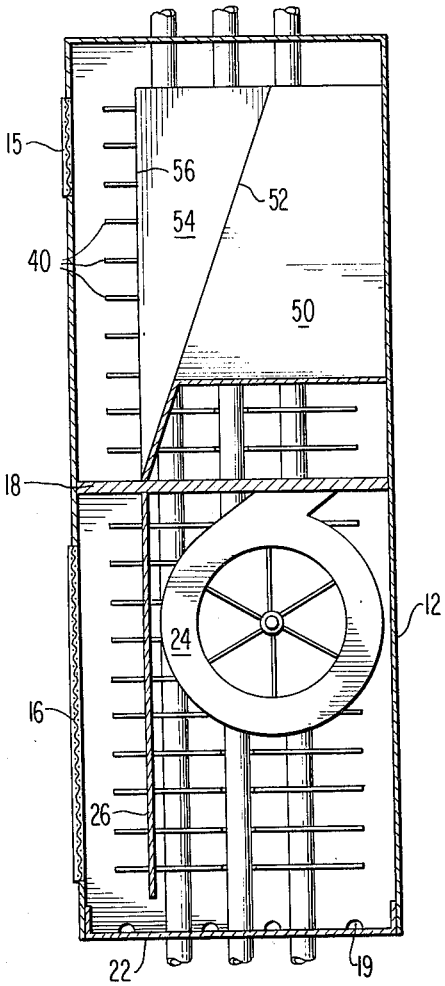
FIG. 4
FIG. 2
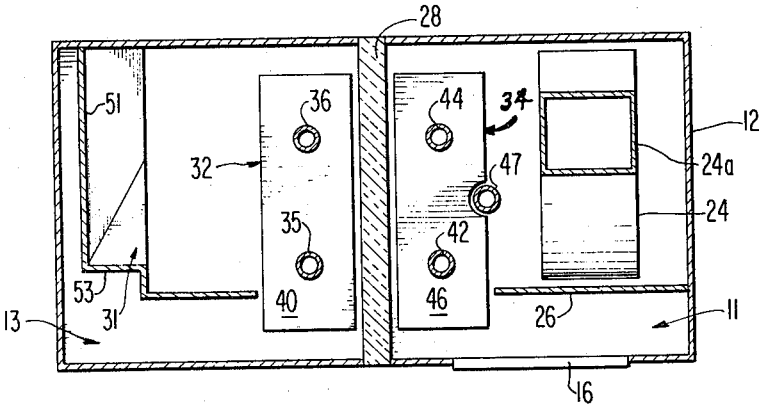

FIG. 3
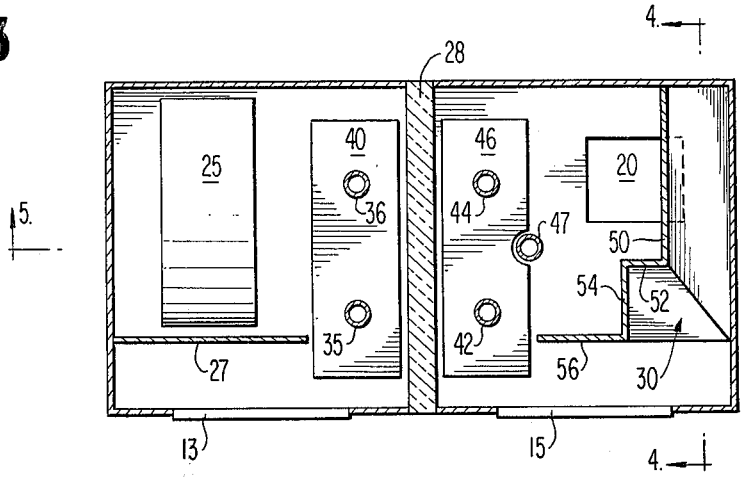
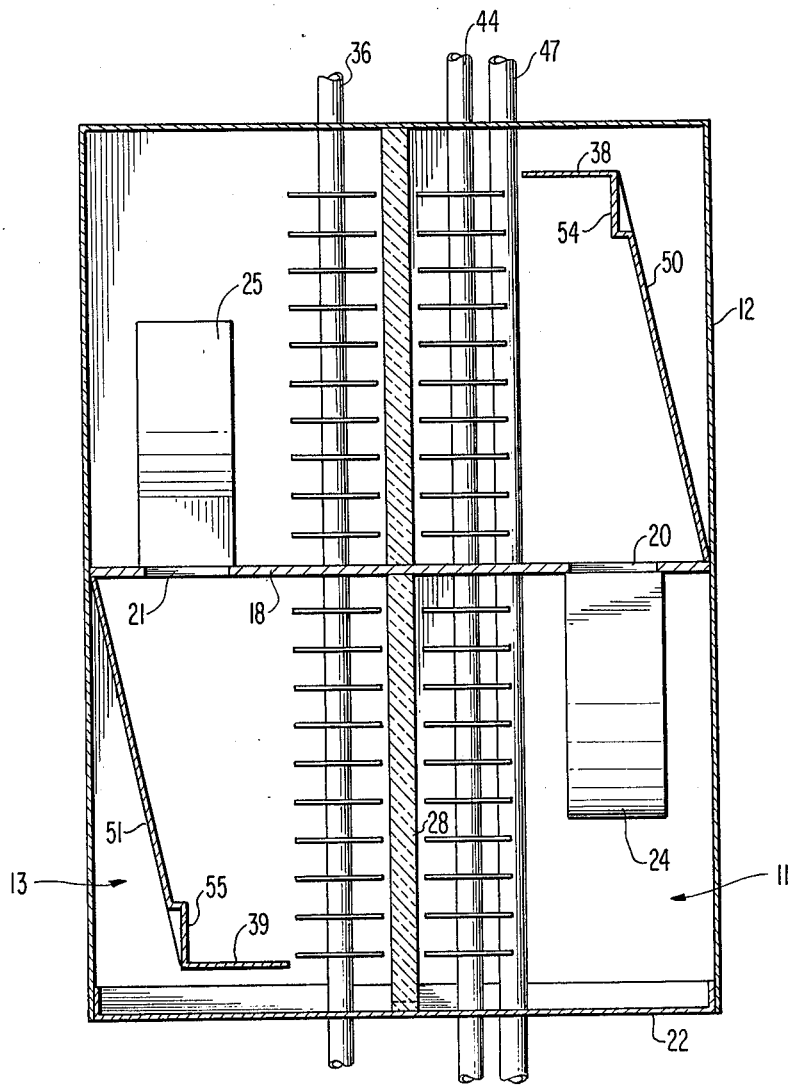
FIG. 5

FOUR RISER HEATING AND COOLING SYSTEM

FIELD OF THE INVENTION

The present invention relates to a heating and cooling unit and, more particularly, to a four riser unit for incorporating a water system to selectively heat or cool a room in which it is installed.

BACKGROUND OF THE INVENTION

Several types of prior art water systems have been proposed for heating and/or cooling a plurality of rooms in a building. In the basic water system, heat exchange units are provided in the various rooms and are connected with a main closed circuit which includes either hot water heating apparatus or water cooling apparatus or both. The heating or cooling apparatus raises or reduces the temperature of the water and a suitable pump forces the water into the main flow circuit and into the heat exchange units, after which it is returned to the apparatus for either heating or cooling.

A majority of these prior art systems usually require several horizontally extended conduits to connect each heat exchanger to the main flow circuit which adds to the materials costs of the system. Also, the labor required to make the necessary connections is an additional expense.

In the type of system in which two risers is used, the system must be manually converted from a heating mode to a cooling mode, or vice versa, at the appropriate time of the year. This requires the entire system to be shut down and the use of a skilled operator to effect the change, and, of course, makes it impossible for some of the individual units in the system to be used in one mode and other units used in the other mode at the same time.

Two previous U.S. Pat. Nos. (3,648,766 and 3,765,478) by the present applicant have successfully overcome the abovedescribed disadvantages through the use of a damper arrangement. Damper arrangements, like any other movable part, suffer from the disadvantage of possible mechanical failure, as well as increased production costs.

SUMMARY OF THE INVENTION

Accordingly, it is an object of the present invention to overcome the defects of the prior art, such as indicated above.

Another object of the present invention is to provide an improved heating and cooling system.

Another object is to provide a package heat exchanger which can be easily installed in a building with a minimum of pipe-fitting and labor.

Yet another object of the present invention is to provide a heating and cooling unit in which the operational mode can be changed without shutting down the entire system, without the need for a skilled operator, and independent of the particular mode of other units in the system.

Still another object is to provide such a unit which accomplishes this function through the use of a minimal number of movable parts.

In furtherance of these and other objects, a principal feature of the heating and cooling unit of the instant invention is the provision of a four pipe duplex heating and cooling unit comprising a single elongated housing including a pair of two-pipe riser heat exchangers and two fans. One riser heat exchanger and one fan are positioned on one side of the housing, while the other riser heat exchanger and fan are positioned on the other side of the housing. Another feature is that one riser heat exchanger and fan combination may be used for cooling, while the other riser heat exchanger and fan combination may be used for heating. Yet another feature is that both of the riser heat exchanger and fan combinations may be used for heating or both may be used for cooling. Thus, the shortcomings of the prior art heating and cooling units are satisfactorily overcome by the present invention.

The heating and cooling unit of the present invention includes a housing comprising first and second separated compartments. The first compartment is provided with an air inlet, an air outlet, an air heat exchanger and circulating means for drawing air into the first compartment inlet, blowing the air through the first compartment in a path passing over the air heat exchanger thereof and discharging the air through the first compartment outlet. The air heat exchanger of the first compartment includes two substantially vertical risers extending beyond the length of the housing for direct connection to the risers of corresponding units located on adjacent floors of the building to form a continuous flow circuit for a first heat exchange fluid. The second compartment is also provided with an air inlet, an air outlet, an air heat exchanger and circulating means for drawing air into the second compartment in a path passing over the air heat exchanger thereof and discharging the air through the second compartment outlet. The air heat exchanger of the second compartment includes two substantially vertical risers extending beyond the length of the housing for direct connection to the risers of corresponding units located on adjacent floors of the building to form a continuous flow circuit for a second heat exchange fluid.

For a better understanding of the invention, a possible embodiment thereof will now be described with reference to the attached drawing, it being understood that this embodiment is intended to be merely exemplary and in no way limitative.

BRIEF DESCRIPTION OF THE DRAWING

FIG. 1 is a perspective view of the heating and cooling unit of the present invention.

FIG. 2 is a cross-sectional view thereof taken along the line 2—2 of FIG. 1;

FIG. 3 is a cross-sectional view thereof taken along the line 3—3 of FIG. 1; and FIG. 4 is a cross-sectional view thereof taken along the line 4—4 of FIG. 3.

FIG. 5 is a cross-sectional view thereof taken along the line 5—5 of FIG. 3.

DETAILED DESCRIPTION OF THE DRAWING

Referring specifically to FIG. 1, the heating and cooling unit of the present invention is shown in general by the reference numeral 10 and comprises an elongated housing 12 adapted to extend from the floor to ceiling in the room in which it is mounted. The front wall of the housing 12 has two pairs of elongated openings, one opening on each side of the upper and lower portions thereof to receive air intake and outlet grills 13, 14, 15 and 16. A thermostat 17 is mounted in the front wall of the housing for controlling the operation of the unit in a manner to be described in detail hereinbelow.

Referring now to FIGS. 2–5, a vertical partition 28 is mounted in the housing 12 in any known manner near the center thereof and divides the housing into right and left compartments, 11 and 13. The partition 28 is equal to the shape of the cross-section of housing 12 with the exception of openings 19 at the bottom thereof to let condensation water pass therethrough, the right compartment 11 of the housing as viewed in FIGS. 2, 3 and 5 is the cooling unit in normal operation and the left compartment 13 is the heating unit.

A transverse horizontal partition 18 is also mounted in the housing 12 in any known manner near the center thereof. The partition 18 is equal to the shape of the cross-section of housing 12 with the exception of two cut-out openings 20 and 21 in order to provide a fan discharge.

Each of the two longitudinally extending compartments 11 and 13, separated by partition 28, contains a riser heat exchanger shown in general by reference numerals 32 and 34. The heat exchanger 32 comprises two vertically extending, spaced risers 35 and 36 which extend the entire length of the housing and project therefrom slightly.

A plurality of rectangular, spaced plates 40 extend over the risers 35 and 36 with openings provided in the plates to receive the risers. The plates 40 extend through the entire length of the compartment defined between partitions 18 and 38 in order to perform a heat exchange function that will be described in detail.

Similarly, the heat exchanger 34 comprises two vertically extending risers 42 and 44 arranged and mounted in a similar manner as risers 35 and 36. A plurality of rectangular, spaced plates 46 are mounted over the risers 42 and 44 and extend from the partition 18 to the partition 38. A drain riser 47 is disposed adjacent to plates 46 with the latter being notched to accommodate the riser. The riser 47 extends for the entire length of the housing to provide a draining function as will be described hereinbelow.

The unit 10 is designed for installation in a multistory building and the portions of the risers 35, 36, 42, 44 and 47 which project from the upper and lower ends of the housing 12 are of a precisely predetermined length to enable them to be directly connected to corresponding risers in identical units formed on floors of the building adjacent to the floor on which the unit 10 is mounted. The connections would most likely be made in bores formed in the floor (or ceiling) in the particular rooms involved, with the connections being made in any conventional manner such as tubular coupling devices, etc.

Partition 28 is preferably made of a suitable insulating material to provide insultion between the two heat exchangers 32 and 34. It should be understood that insulating material may appear on either or both sides of partition 28 made of any conventional material.

The risers 42 and 44 are connected to a central cooling system which may be in the form of a cooling tower, or the like, for providing relatively cool water therethrough. The water is pumped directly from the cooling system through riser 42 and the corresponding risers connected thereto in the units on adjacent floors, and is returned by the riser 44 and its corresponding risers. For example, if the cooling system is provided on the top of the building, a pump would be provided to pump the relatively cool water directly from the cooling system through the riser 42 and its corresponding risers, to the bottom of the building whereby a U-shaped connection, or the like, would reverse the direction of flow and permit return of the water through the riser 44 and its corresponding risers.

In a similar manner, the risers 35 and 36 are connected to a central heating system mounted within or on the building, with the heated water being passed from the heating system through the riser 35 and its corresponding risers, and in a return path from the riser 36 and its corresponding risers, to the heating system.

Each compartment 11 and 13 contains a scroll fan 24, 25 and a hood 30, 31. The fan in cooling compartment 11 is located below partition 18 and directs air upwardly into hood 30 above partition 18. A vertical partition 26 is located parallel to the front wall of housing 12 in compartment 11 between the front wall and fan 24. Partition 26 extends from the bottom portion of the housing 12 above drain pan 22 to partition 18 and from the side wall of housing 12 to a point in proximity to heat exchanger fins 46. The partition 26 thus serves to cause air drawn in through inlet grill 16 to pass through heat exchanger 34 before entering fan 24.

While fan 24 may be of any conventional type to force air in grill 16 and through opening 20 into the upper part of compartment 11, it is preferably a scroll fan which draws air axially in both sides thereof and forces it tangentially through an outlet 24a which registers with discharge opening 20. For further details of the scroll fans usable in the present invention, including the manner in which they may be mounted in the housing, reference is made to Applicant's U.S. Pat. No. 3,648,766.

Above the partition 18 in compartment 11 is a means for directing the air again through heat exchanger 34 before being discharged through outlet grill 15 into the room. Such a means may be a hood 30 made up of vertical partitions 54 and 56 and slanted partitions 50 and 52.

Heating compartment 13 is the same as the cooling compartment 11 except that the fan 25 is positioned above the partition 18 and directs the air downwardly into hood 31 comprising partitions 51, 53, 55 and 57 extending below partition 18. In this manner air may be drawn in inlet grill 13 at the upper portion of housing 12, through heat exchanger 32 into fan 25, again through heat exchanger 32, and out outlet grill 14 at the bottom portion of housing 12. Thus, when in the heating mode, hot air is discharged near the bottom of the room through grill 14 while, when in the cooling mode, cool air is discharged through grill 15 near the top of the room.

The fans 24 and 25 are electrically connected to, and controlled by, the thermostat 17. The thermostat 17 may be of the "dead band" variety which incorporates an element movable between two spaced fixed elements in response to temperature variation. Upon the movable element contacting one fixed element, fan 24 may be activated and upon the movable element contracting the other fixed element, fan 25 may be activated with the fans being turned off during its movement between fixed elements.

A drain pan 22 rests on the floor of the housing 12 and serves to collect condensation caused by the heat exchangers occurring in the housing, it being understood that the drain pipe 47 is notched in the vicinity of the pan so that excess condensation is transferred through the latter pipe and its corresponding pipes to a central grain, preferably located in the basement of the building. Further details of this drain system system are set forth in Applicant's U.S. Pat. No. 3,648,766, granted Mar. 14, 1972, the disclosure of which is hereby incorporated by reference.

In operation, and assuming the termperature in the individual room in which the unit 10 is installed drops from a relatively high value to a predetermined relatively low value, the movable element of the thermostat 17 will make contact with one of the fixed elements, actuating the fan 25 in the hot water circuit. As a result, air will be drawn into the inlet grill 13, and into fan 25, through heat exchanger 32 where it is initially heated whereby it is circulated from the fan discharge opening 21 again through the hot heat exchanger 32 and is there further heated before passing out through the outlet grill 14 at the lower end of the housing. Air flow is prevented over the cold heat exchanger 34 by virtue of the inoperation of the fan 24. When the temperature in the room rises to a predetermined comfort condition, the movable element of the thermostat releases from the above-mentioned fixed element, and the fan 25 will be turned off until the temperature once again drops to the predetermined low temperature and the movable element again touches the latter fixed element.

If the temperature in the individual room in which the unit is installed rises from a relatively low value to a predetermined relatively high value, the movable element of the thermostat 17 will actuate fan 24 in the cold water circuit. As a result, air will be drawn into the inlet grill 16 at the bottom of the housing, through heat exchanger 34 and into fan 24 where it is circulated from the fan discharge opening 20 again through the cold heat exchanger 34 where it is further cooled before passing out the outlet grill 15 at the top of the housing. Air flow is prevented over the hot heat exchanger 32 by virtue of the inoperation of fan 25. When the temperature in the room drops to the predetermined comfort condition, the fan 24 will be turned off until the temperature again rises to the relatively high value.

It should be understood that the instant invention may be used in conjunction with the 50 plus 50 system disclosed in Applicant's co-pending U.S. patent application, Ser. No. 463,047, filed on Apr. 19, 1974, the disclosure of which is hereby incorporated by reference. When used in such a system, both the hot heat exchanger 32 and the cold heat exchanger 34 may be used for heating and/or cooling. Thus, temperature sensitive devices are attached to the heating risers 42 and 44 and connected to the fan 24. A temperature sensitive device actuates fan 24 when a hot temperature is sensed in the normally cold fluid conducting pipes 42 and 44. Similarly, a temperature sensitive device (not shown) is attached to the heating risers 35 and 36 and connected to the fan 25. This device actuates the fan 25 when a cold temperature is sensed within the normally hot fluid conducting pipes 35 and 36. In this manner, when the room temperature is particularly cold (or hot), heating fluid (or cooling fluid) may be supplied to all four risers and both fans 24 and 25 operated simultaneously to allow hot (or cool) air to be discharged from both heat exchangers 32 and 34. The air in this mode will be discharged at both the top and the bottom of the room.

It should be understood that other means may be used to direct the air from the fans and through the heat exchangers besides partitions 26 and 27 and hoods 30 and 31. For example, the heat exchangers could be placed at a small distance from partition 28 and horizontal partitions used alternately extending from the side wall of housing 12 to the heat exchanger and from the partition 28 to the heat exchanger to direct the air in a serpentine path back and forth through the entire length of the heat exchanger.

Furthermore, fans other than the scroll fans disclosed may be used. For example, suitable reversible fans could be used to ensure that heated air is always coming from the bottom grills and cool air is always coming from the upper grills.

It is thus seen that the present invention can easily be installed in a building with a minimum of pipe-fitting and labor by virtue of the vertically extending risers. Also, the individual unit in the building can be individually controlled by regulating the thermostat associated with each unit without the need for a skilled operator, and independent of the particular mode of other units in the system. The operational mode of the unit can be changed between heating or cooling automatically and through the use of a minimal number of moving parts.

The foregoing description of this specific embodiment will so fully reveal the nature of the invention that others can, by applying current knowledge, readily apply this embodiment and/or adapt it to various applications without departing from the generic concept, and, therefore, such adaptations and modificiations should and are intended to be comprehended within the meaning and range of equivalents of the disclosed embodiments. Further, it is to be understood that the phraseology or the terminology employed herein is for the purpose of description and not of limitation.

What is claimed is:

1. A unit for heating or cooling air in a room of a multistory building comprising:

a housing having a first and a second compartment;

a first air inlet in said first compartment;

a first air outlet in said first compartment;

a first heat exchanger in siad first compartment;

first circulating means in said first compartment for drawing air into said first air inlet, flowing the air through said first compartment in a path passing over said first heat exchanger, and discharging the air through said first air outlet;

said first heat exchanger including two substantially vertical risers extending the length of said housing for direct connection to the risers of corresponding units located on adjacent floors of the building to form a continuous flow circuit for a first heat exchange fluid;

a second air inlet in said second compartment;

a second air outlet in said second compartment;

a second heat exchanger in said second compartment;

second circulating means in said second compartment for drawing air into said second air inlet, flowing the air through said second compartment in a path passing over said second heat exchanger, and discharging the air through said second air outlet;

said second heat exchanger including two substantially vertical risers extending the length of said housing for direct connection to the risers of corresponding units located on adjacent floors of the building to form a continuous flow circuit for a second heat exchange fluid; and a single thermostat means connected to said first and second circulating means for operating said first and second circulating means responsive to the temperature in the room whereby selected stories of the building can be heated while others are simultaneously cooled.

2. A unit in accordance with claim 1, further comprising means for providing insulation between said first and said second compartments.

3. A unit in accordance with claim 1, wherein said first circulating means and said second circulating means are fans.

4. A unit in accordance with claim 3, wherein said fans are reversible.

5. A unit in accordance with claim 1, wherein said first heat exchange fluid is relatively hot and said second heat exchange fluid is relatively cool.

6. A unit in accordance with claim 1, wherein said first heat exchange fluid and said second heat exchange fluid are both relatively hot.

7. A unit in accordance with claim 1, wherein said first heat exchange fluid and said second heat exchange fluid are both relatively cool.

8. A unit in accordance with claim 1, wherein each of said first and second heat exchangers further comprise a plurality of plates extending over said risers to perform a heat exchange function between said heat exchange fluid and said air.

9. A unit in accordance with claim 1, wherein the length of said housing is substantially equal to the height of the room in which it is mounted.

10. A unit in accordance with claim 3 further including first directing means for directing air drawn by said first circulating means through said first heat exchanger before entering said fan and for directing the air discharged by said fan again through said first heat exchanger before being discharged through said first air outlet, and second directing means for directing air drawn by said second circulating means through said second heat exchanger before entering said fan and for directing the air discharged by said fan again through said second heat exchanger before being discharged through said second air outlet.

11. A unit in accordance with claim 5, wherein said first inlet is located near the top of said housing and said first outlet is located near the bottom of said housing, and wherein said second inlet is located near the bottom of said housing and said second outlet is located near the top of said housing.

12. A unit in accordance with claim 1, wherein said thermostat means includes an element moveable between two spaced fixed elements in response to temperature variation for activating said first and second circulating means alternately.

13. A unit in accordance with claim 6 wherein said thermostat means includes a temperature sensitive device located in said vertical risers in said first and second circulating means for actuating both first and second circulating means simultaneously.

14. A unit in accordance with claim 7 wherein said thermostat means includes a temperature sensitive device located in said vertical risers in said first and second circulating means for actuating both first and second circulating means simultaneously.

* * * * *